US006860073B2

(12) United States Patent
Chien

(10) Patent No.: US 6,860,073 B2
(45) Date of Patent: Mar. 1, 2005

(54) STRUCTURE OF A COMBINATIVE INTERLOCKING BOARD ENCLOSING VERTICAL AND HORIZONTAL PIPES

(76) Inventor: Yaw-Jiun Chien, PO Box 82-144, Taipei (TW)

( * ) Notice: Subject to any disclaimer, the term of this patent is extended or adjusted under 35 U.S.C. 154(b) by 98 days.

(21) Appl. No.: 10/355,089

(22) Filed: Jan. 31, 2003

(65) Prior Publication Data

US 2004/0154245 A1 Aug. 12, 2004

(51) Int. Cl.[7] ..... E04C 2/52

(52) U.S. Cl. ..... 52/220.1; 52/220.3; 52/220.7; 52/220.8; 52/592.5

(58) Field of Search ..... 52/592.5, 592.1, 52/592.6, 220.1, 226.7, 220.3, 220.8

(56) References Cited

U.S. PATENT DOCUMENTS 2,114,387 A * 4/1938 Killion ..... 52/220.7
4,671,032 A * 6/1987 Reynolds ..... 52/220.1
5,175,969 A * 1/1993 Knauf et al. ..... 52/220.7
5,726,387 A * 3/1998 Teinturier et al. ..... 52/220.7
5,746,034 A * 5/1998 Luchetti et al. ..... 52/220.7

* cited by examiner

*Primary Examiner*—Anthony D. Barfield
(74) *Attorney, Agent, or Firm*—Leong C. Lei

(57) ABSTRACT

A structure of a combinative interlocking board containing vertical and horizontal pipes is disclosed. The piping within the board divides the board into a middle region and two side regions, and the middle region is a piping passage for conduits and the piping connectors, and is provided with an actuating opening, the two side regions is conduits for screws in vertical and horizontal direction. The four corners of the board are provided with opening for the mounting of an interlocking plate allowing screws to pass through so as to lock the boards with each other. The decorative panels mounted to the board can be replaced.

1 Claim, 8 Drawing Sheets

STRUCTURE OF A COMBINATIVE INTERLOCKING BOARD ENCLOSING VERTICAL AND HORIZONTAL PIPES

BACKGROUND OF THE INVENTION (a) Technical Field of the Invention

The present invention relates to combinative board structure, and in particular, to board structure having mounted with piping and a plurality of pipes can be mounted or connected to each other in horizontal and vertical direction.

(b) Description of the Prior Art

In conventional construction, material for wall such as concrete, prefabricated walls or glass partitions, ceramic tiles, wall tiles, light-weight board, ceiling boards, etc. and material for ceiling such as wooden board, etc. have the following drawbacks:

(1) the material is limited to a specific application,
(2) a large amount of cements, sands, etc are needed,
(3) inconvenient in repairing,
(4) a large amount of waste is produced during renovation or repairing,
(5) a plurality of supports are needed during application,
(6) all fixtures are fixed and cannot be removed or changed,
(7) additional piping cannot be embedded,
(8) the decorative panel cannot be changed anytime,
(9) in case water leakage, the boards may be damaged,
(10) the sequence of renovation is fixed,
(11) if the floor is uneven, the floor has to be leveled to proceed to tiling,
(12) the installation of piping cannot be done simultaneously with the fixing of the structure.

Accordingly it is an object of the present invention to provide a structure of a combinative interlocking board containing vertical and horizontal pipes, which mitigates the above drawbacks.

SUMMARY OF THE INVENTION

Accordingly, it is an object of the present invention to provide a structure of a combinative interlocking board containing vertical and horizontal pipes, the board is divided into a middle region and two side regions, and the middle region is a piping passage for pipes and cables, and the piping passage includes a male and female bonding seat with actuating opening and are separately moved horizontally or vertically to engage with each other, the outer edge of the opening is provided with a plurality of locking holes, and the four corners of the board are provided with a water-proof device and a water-proof slot; by means of the screw hole tubing at the two side regions, the boards can be fixed with screws, and an opening is provided at the side of the four corners, and the opening is provided internally with a locking plate for the connection of the boards.

Yet another object of the present invention is to provide a structure of a combinative interlocking board containing vertical and horizontal pipes, wherein the boards are mounted together by at least a method.

A further object of the present invention is to provide a structure of a combinative interlocking board containing vertical and horizontal pipes, wherein a layer of refractory board, thermal resistance board, sound-proof board or water-proof board can be mounted.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 8:
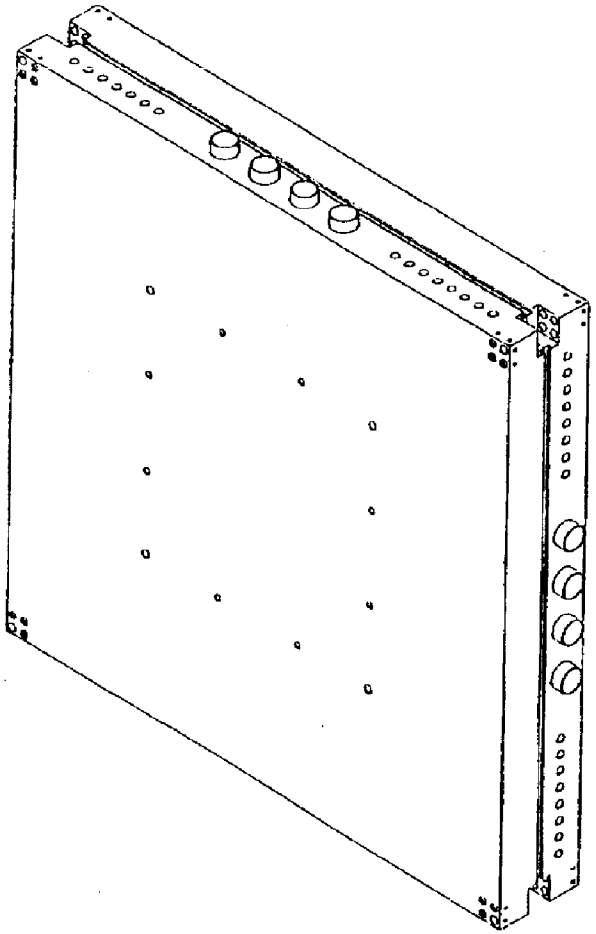
FIG. 8 is a schematic view of the combination in accordance with the present invention.

Referring to FIGS. 1A, 1B, 2, 3A, 3B and 3C, there is shown a structure of a combinative interlocking board containing vertical and horizontal pipes. The board structure 10 can be used separately or mounted with other board structure to form as a unit. The board structure 10 divided into a middle region and two side regions, and the middle region is a piping passage 11 for cables or piping and the piping passage includes a male engaging seat 111, and a female engaging seat 112 and is provided with an actuating opening 12, or is sealed as shown in FIG. 8. An actuating board 121 is mounted to the actuating opening 12, and the outer edge of the actuating opening 12 is provided with a plurality of locking holes 13 (the holes at the surrounding of the board can be the bonding hole 16 for engaging with the panel board 40 of a decorative panel 50) for the mounting of another board 10 either vertically or horizontally. The corners of the board are provided with a water-proof device 19 and a water-proof slot.

The internal of the board is provided, based on the function thereof, with one or more than one pipes, or a rows of pipes, or a mixture of large and small pipes.

The two side regions are provided with screw hole tube 14 and the upper and lower section of the tube are provided with screw threads for the mounting with screws 30. The corners of the board 10 are each provided with an opening 15 having a board bonding device provided with bonding holes, locking holes, and securing holes. The locking hole is used for the securing of an interlinking plate. The bonding holes are used for the mounting of the decorative panel and, a plurality of locking hole 17 and securing hole 20 are provided correspondingly to the locking plate 20. A plurality of screw rods 31 pass through the locking hole and the board is secured with the interlocking plate. The four corners of the board are mounted by the interlocking plate at the top and bottom thereof.

Figure 1A:
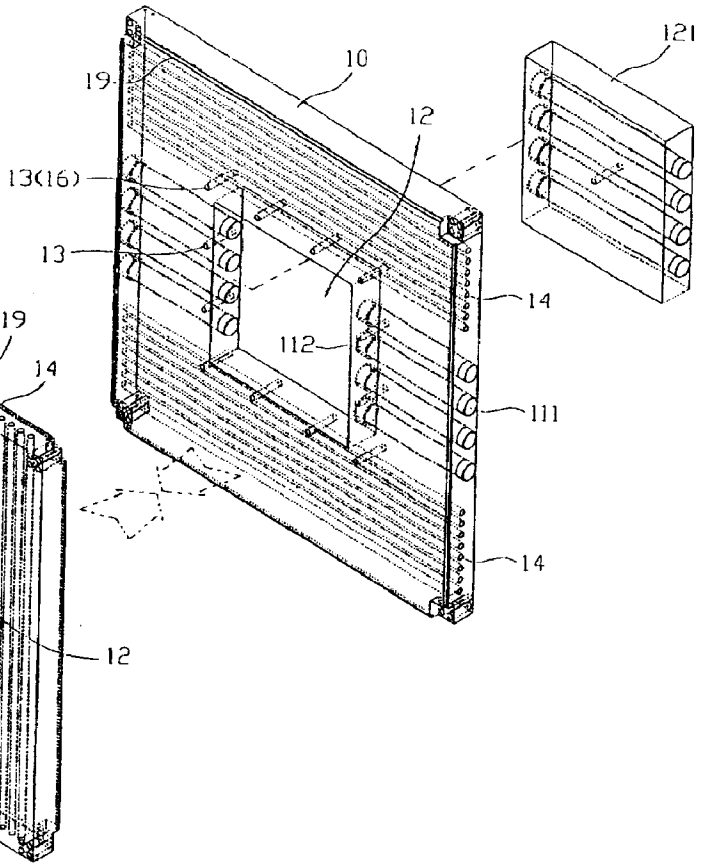
FIG. 1A is a perspective view of a structure of a combinative interlocking board containing vertical and horizontal pipes of the present invention.
Figure 1B:
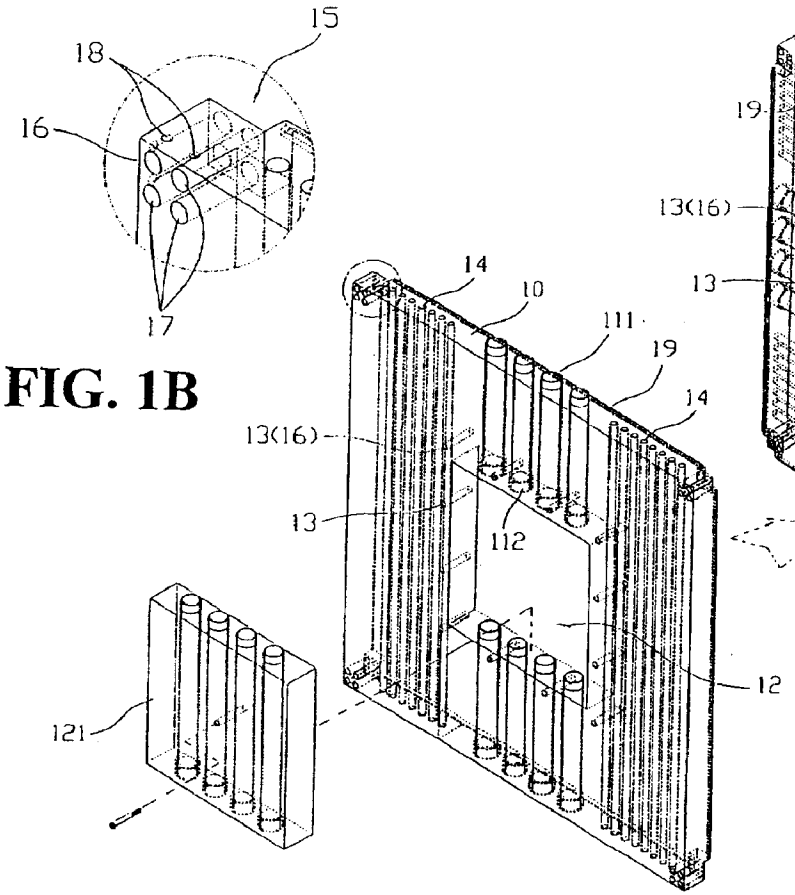
FIG. 1B is an enlarged view of a portion of FIG. 1A.
Figure 2:
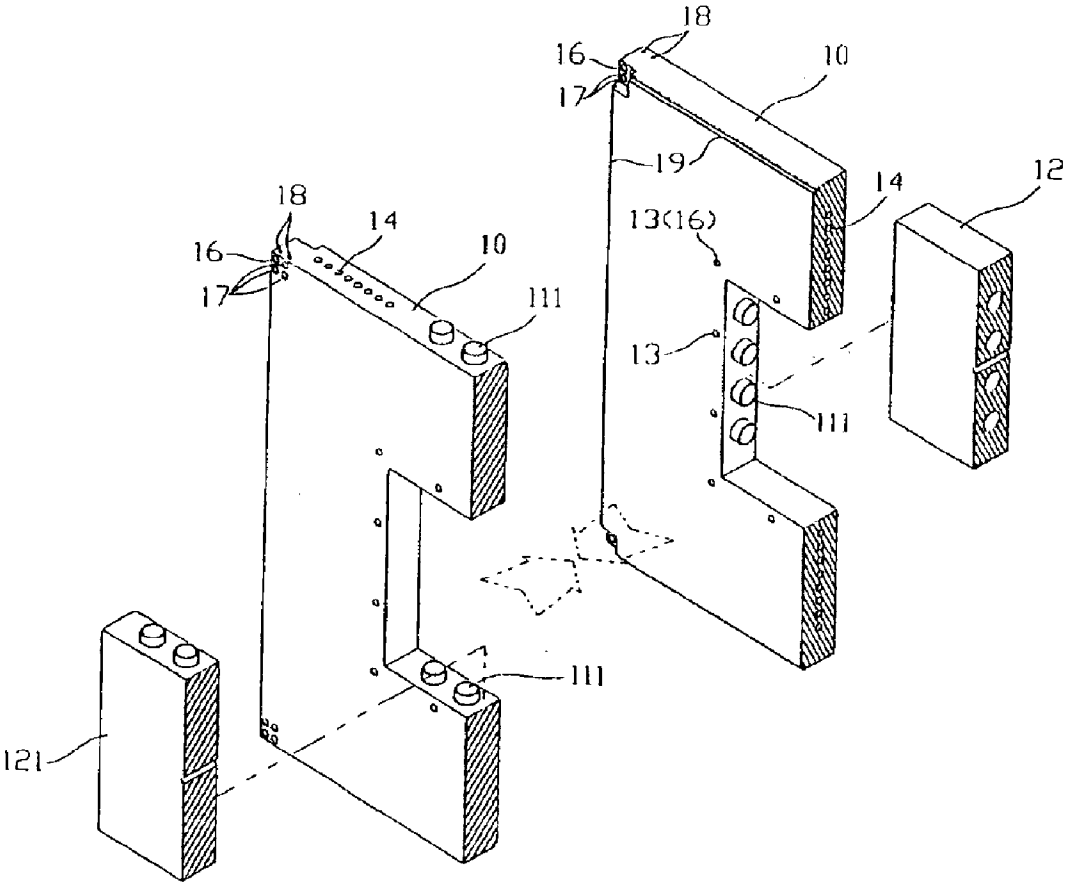
FIG. 2 is a sectional view of a structure of a combinative interlocking board containing vertical and horizontal pipes of the present invention.
Figures 3A, 3B, 3C:
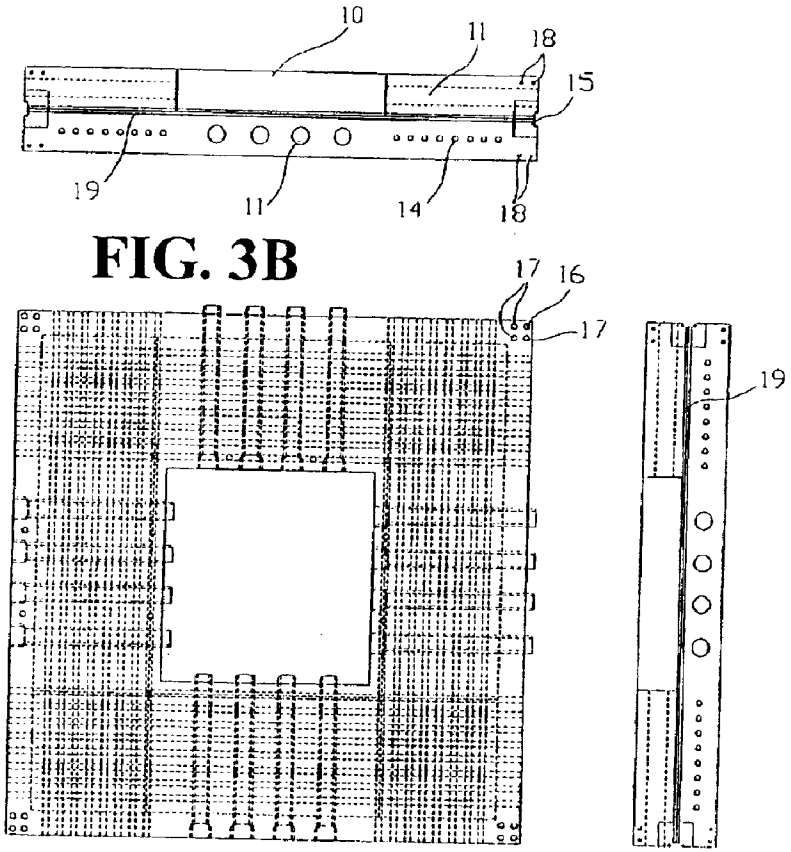
FIG. 3A is a top view of a structure of a combinative interlocking board containing vertical and horizontal pipes in accordance with the present invention.
FIG. 3B is a front view of FIG. 3A.
FIG. 3C is a side view of FIG. 3A.
Figure 4B:
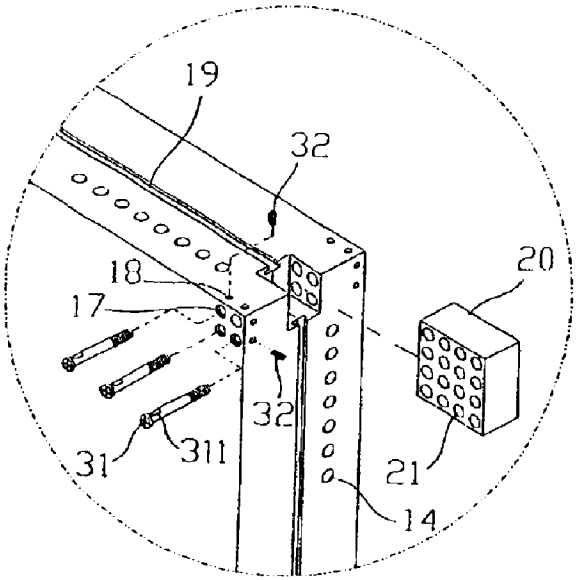
FIG. 4B is an enlarged view of a portion of FIG. 4A.
Figure 4A:
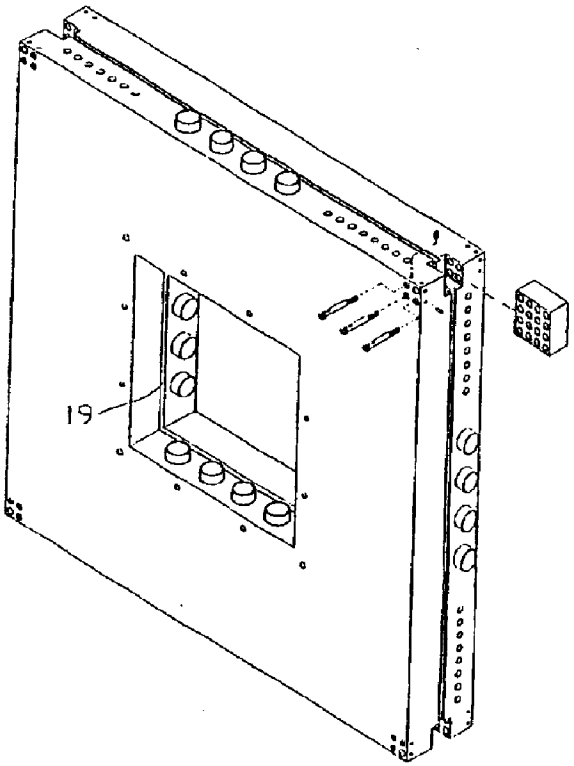
FIG. 4A is a schematic view showing the combination of a structure of a combinative interlocking board containing vertical and horizontal pipes in accordance with the present invention.

Referring to FIGS. 4A, 4B, 5A, 5B and 5C, there is shown a preferred embodiment in accordance with the present invention. The four corners of the board structure are each provided with an opening 15. The outer end of the board surface is provided with a bonding hole 16, and the inner edge thereof is divided into a locking hole 17, and the individual corner of the structure board is correspondingly provided with a bonding hole, a locking hole and a securing hole 18. The interlocking plate 20 is placed within the opening such that the through hole 21 on the interlocking plate 20 is corresponding to the locking hole. The two sides of the structure board are mounted to the interlocking plate by means of a plurality of screw rods 32. The screw rods 32 pass through the prefabricated hole 311 (as shown in FIG. 4A) and the securing of the board structure is enhanced.

Figures 5A, 5B, 5C:
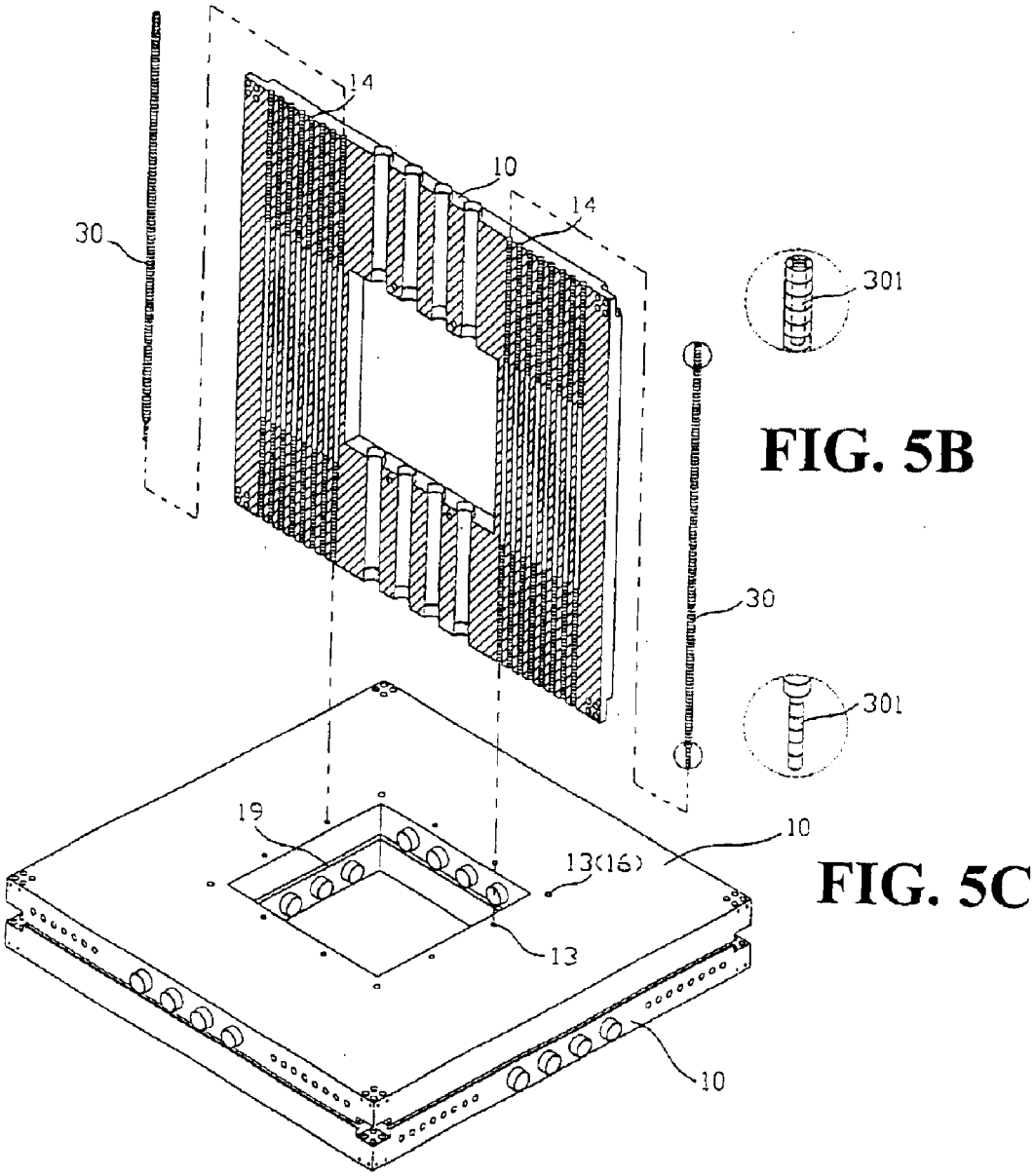
FIG. 5A is a schematic view showing the mounting of screws to the structure in accordance with the present invention.
FIG. 5B is an enlarged view of a portion of FIG. 5A.
FIG. 5C is an enlarged view of a portion of FIG. 5A.
Figure 7:
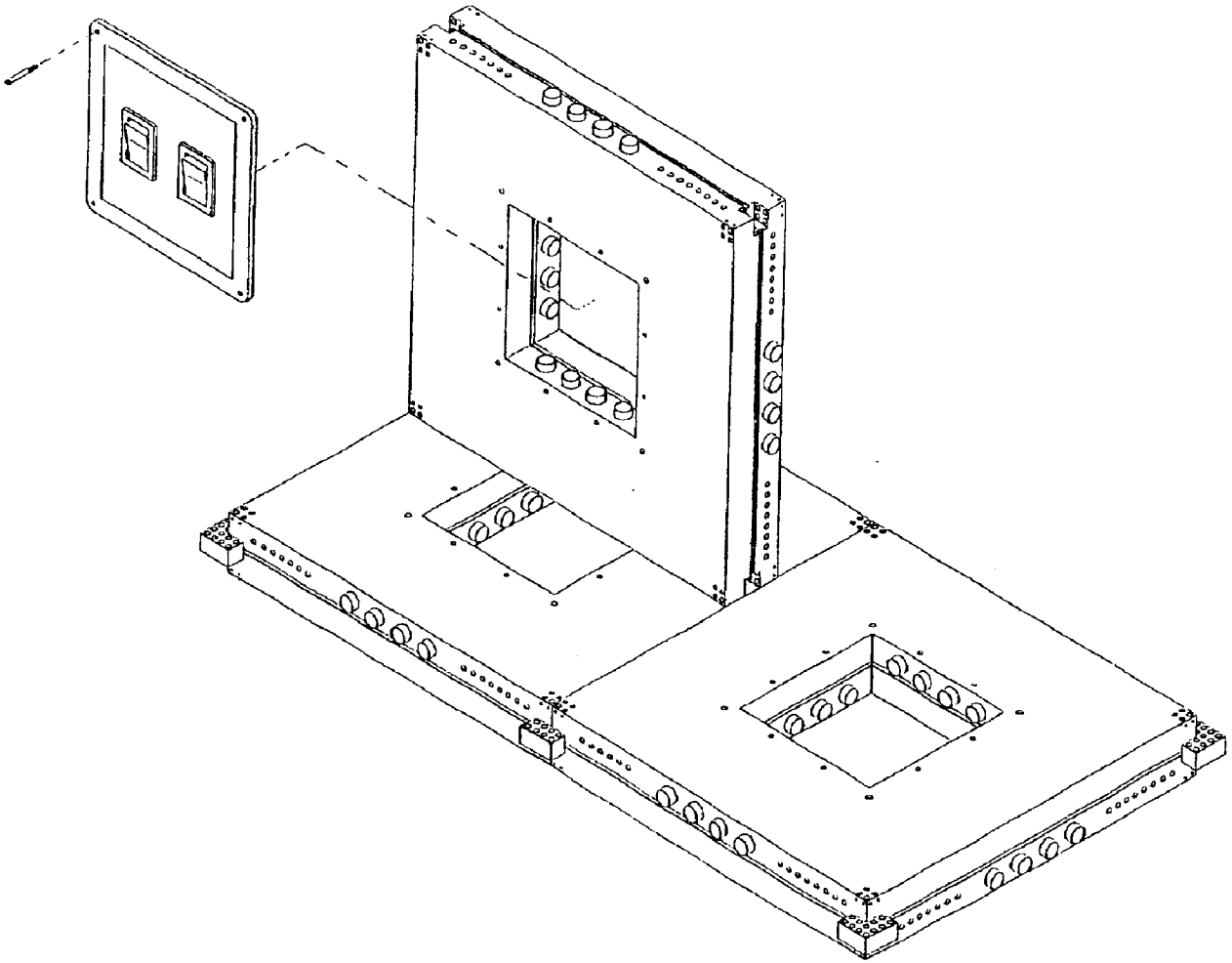
FIG. 7 is a perspective view showing a second preferred embodiment in accordance with the present invention.

The two side regions of the board structure 10 are provided with screw holes 14 spaced equally, and the upper and bottom section of the screw tube are provided with threads so that screw 30 can pass through. The two ends of the screw is a connector 30, with a male and female connection for mounting with locking holes provided at the opening at the outer edge, as shown in FIGS. 5A, 5B and 5C. FIGS. 7 and 8 show another preferred embodiment of the present invention.

Figures 6A, 6B:
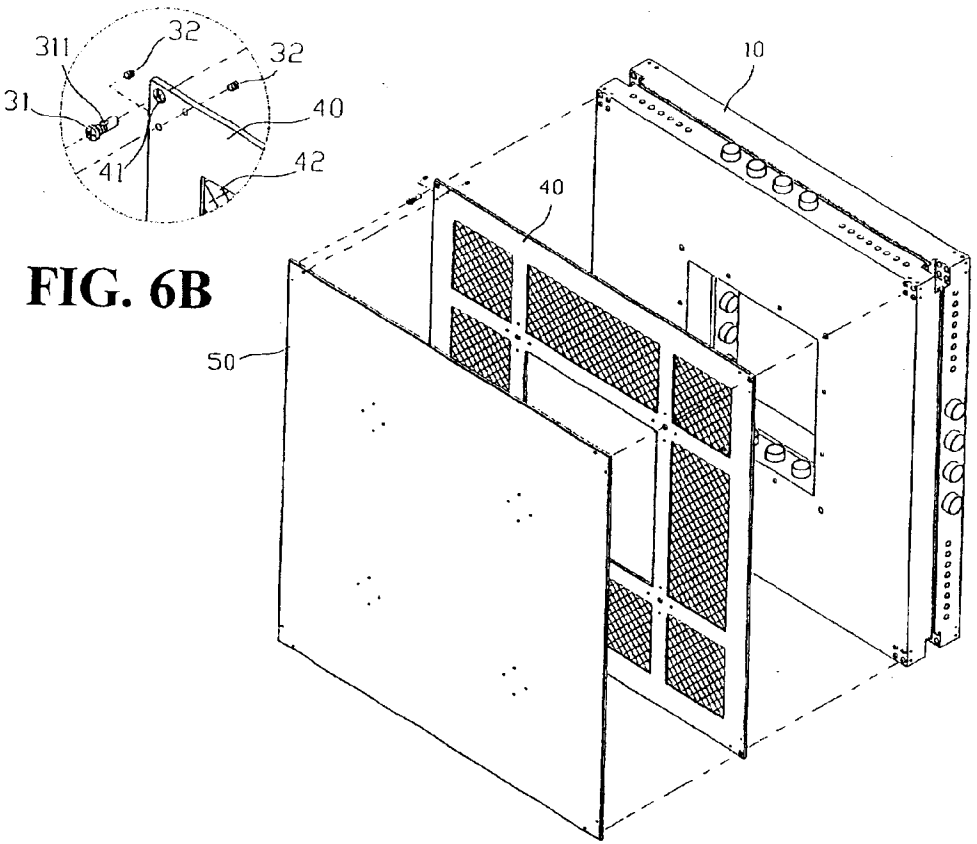
FIG. 6A is a perspective view showing the combination of the decorative panel in accordance with the present invention.
FIG. 6B is an enlarged view of a portion of FIG. 6A.

Referring to FIGS. 6A and 6B, the opening 15 of the board structure 10 after combination, the outer end of the board surface is provided with bonding hole 16, and the external edge of the actuating hole is provided with a locking hole 13, which is corresponding to the through hole 41 of the framing board 40. The framing board 40 is provided with a netlike board 42 for the adhesion of the decorative panel 50. The small holes 43 at the surrounding of the through hole are for the mounting with small screws 32 onto the decorative panel.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a combinative interlocking board comprising a middle region and two side regions, said middle region having a plurality of piping passages which includes a male engaging seat and a female engaging seat with an actuating opening, an actuating board mounted to said actuating opening, an outer edge of said actuating opening being provided with a plurality of locking holes for mounting of another one of said board either vertically or horizontally, corners of said board being provided with a water-proof device and a water-proof slot, said two side regions being provided with screw hole tubes, said screw hole tubes having an upper and lower sections provided with screw threads for mounting of screws, corners of said board being each provided with an opening having a board bonding device provided with bonding holes for mounting of a decorative panel, locking holes for securing an interlocking plate and securing holes, a plurality of screw rods passing through said locking holes and said board being secured with an interlocking plate, four corners of said board being mounted by said interlocking plate at a top and bottom thereof, said four corners of said board being each provided with an opening, and said opening being provided with a locking plate for connection of said board.

* * * * *